US007857677B2

(12) United States Patent
Kamm

(10) Patent No.: US 7,857,677 B2
(45) Date of Patent: Dec. 28, 2010

(54) INFANT APPARATUS ACTUATED BY SUCKING

(76) Inventor: Kathi Kamm, 5818 N. Ames Ter., Glendale, WI (US) 53209

( * ) Notice: Subject to any disclaimer, the term of this patent is extended or adjusted under 35 U.S.C. 154(b) by 709 days.

(21) Appl. No.: 11/601,324

(22) Filed: Nov. 18, 2006

(65) Prior Publication Data

US 2008/0119108 A1 May 22, 2008

(51) Int. Cl.
*A63H 33/00* (2006.01)
*A61J 17/00* (2006.01)

(52) U.S. Cl. ..... 446/227; 606/236

(58) Field of Classification Search ..... 446/227; 606/234, 236; *A63H 33/00; A61J 17/00*
See application file for complete search history.

(56) References Cited

U.S. PATENT DOCUMENTS 3,790,016 A 2/1974 Kron
4,079,728 A 3/1978 Gatts
4,554,919 A 11/1985 Hubert
4,681,096 A 7/1987 Cuervo
5,292,335 A 3/1994 Shin
5,464,381 A 11/1995 Wilson
5,588,164 A 12/1996 Proulx
5,830,235 A * 11/1998 Standley ..... 606/234
5,853,005 A * 12/1998 Scanlon ..... 600/459
6,033,367 A 3/2000 Goldfield
6,676,475 B1 1/2004 Henderson et al.
6,746,299 B1 6/2004 Graf
2003/0181249 A1* 9/2003 Meade ..... 472/119

* cited by examiner

*Primary Examiner*—Peter DungBa Vo
*Assistant Examiner*—Alex F. R. P. Rada, II
(74) *Attorney, Agent, or Firm*—Absolute Technology Law Group, LLC

(57) ABSTRACT

An apparatus for sensing onset, offset, duration, frequency, and intensity of infant sucking and creating electrical signals which actuate a stimulus producing device in direct response to the infant sucking.

17 Claims, 2 Drawing Sheets

INFANT APPARATUS ACTUATED BY SUCKING

FIELD OF INVENTION

This invention relates generally to the field of devices for infant care, entertainment and development and specifically relates to an apparatus that allows an infant to control a stimulus-producing device by sucking.

BACKGROUND OF THE INVENTION

Figure 1:
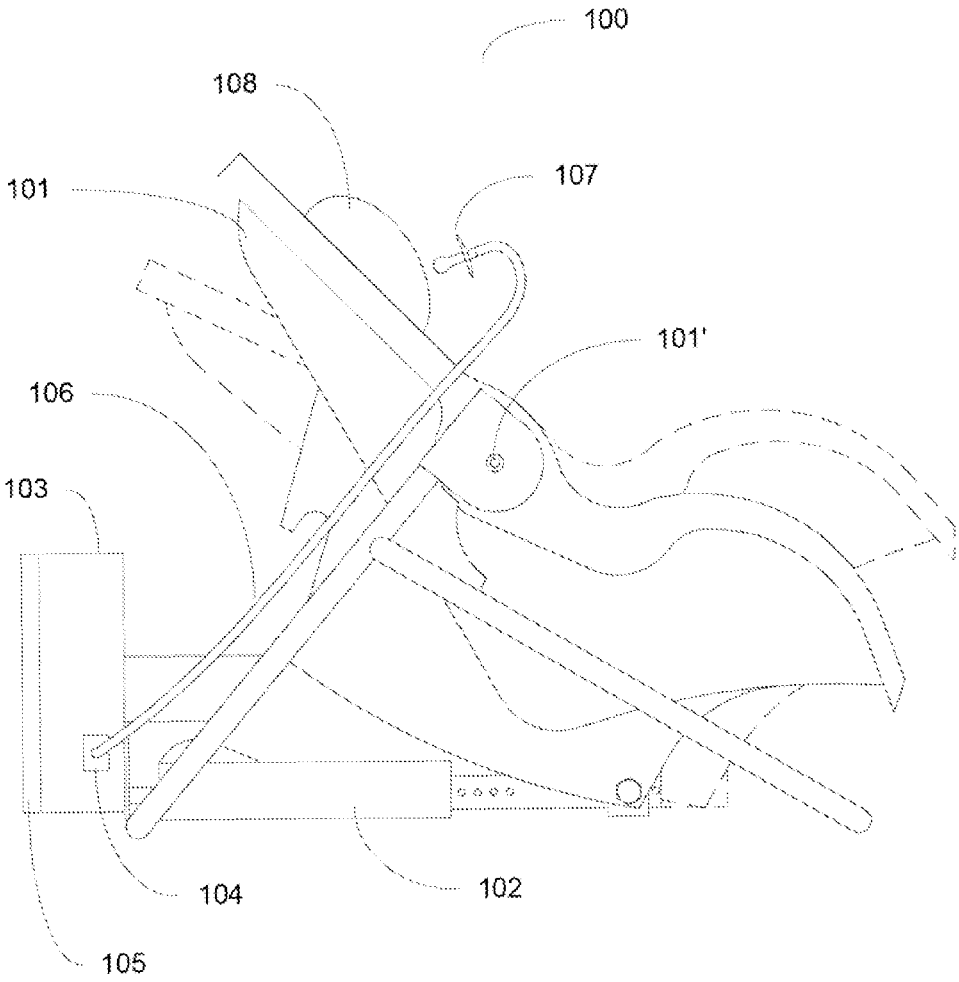
FIG. 1 shows a side view of one embodiment of an apparatus by which sucking on a nipple produces movement of the apparatus.

A 1980 study conducted by DeCasper & Fifer entitled *Of Human Bonding: Newborns Prefer Their Mothers' Voices* concluded that newborn infants learned how to activate the sound of their mother's voice by non-nutritive sucking. This study established that newborn and young infants cognitively make the connection between their sucking parameters (e.g., the offset, onset, duration, frequency, and intensity) and the manipulation of a stimulus (such as a recorded voice). This study determined that newborns will deliberately use the motor skill of sucking to accomplish a task or manipulate a stimulus-producing device. The embodiments of the invention disclosed herein are adapted to utilize the cognitive ability of an infant to make a connection between the manipulation of the stimulus-producing device and their own sucking parameters.

It is a common practice to attempt to soothe crying infants or engage infants from birth (newborn) to approximately twelve months of age using movement (such as rocking or bouncing) or by other audio or visual stimulus. In general, apparatuses which attempt to soothe, engage, stimulate or teach infants are not controlled or actuated by the infant because it is not commonly recognized that infants possess motor skills and cognitive skills to learn to use a specific physical means to create a result that is not directly and physically related to their action. This type of activity is commonly referred to as a "means-ends" task.

It is desirable to create a device which is actuated or controlled by the infant, using the motor skill of sucking which is developmentally present in infants in the newborn to approximate twelve month age range.

The present invention is an apparatus which is actuated and controlled by the offset, onset, duration, frequency, and/or intensity of infant sucking. The apparatus is designed to utilize an infant's awareness of the correlation between his or her own sucking and the stimulus produced by the apparatus and thus allowing the infant to control the stimulus. For example, a stimulus is controlled by frequency and intensity and variations in the sucking.

As used herein, the term "sucking" or "sucking parameters" refers to the offset, onset, frequency, intensity, and/or duration by which an infant sucks on a nipple or other device adapted for sucking.

As used herein, the term "actuate" means to control the movement of an apparatus in response to an input detected by a sensor.

As used herein, the term "actuator" means a device, such as a motor, which creates movement or produces a visual or audio stimulus in response to infant sucking measured by a sensor.

As used herein, the term "nipple" means a device made of rubber, plastic, cloth or other material designed to evoke a sucking response in an infant as would be evoked if the infant were presented with a pacifier, infant feeding bottle or human nipple.

As used herein, the term "sensor" means a device capable of converting data about the offset, onset, duration, frequency and intensity of infant sucking to an electric signal.

As used herein, a "microprocessor" is an integrated computer circuit that is capable of receiving and processing digital electrical signals and contains the circuitry necessary to interpret and execute program instructions controlling movement of an actuator or apparatus.

As used herein, a "tube-shaped conduit" is a tube made of latex, plastic, rubber or other material capable of transmitting air pressure to an electrical sensor or pressure transducer. A tube shaped conduit may also be a wire or a cord.

As used herein "infant stimulation output" means an output which is sensed or felt by an infant such as movement, visual stimulus or auditory stimulus.

As used herein the term "infant support structure" means any object capable of holding, securing or supporting an infant such as an infant seat, car seat, carrier, swing, stroller, bassinette, harness, or other device in which an infant may be supported or placed As used herein the term "non-nutritive sucking" means sucking which does not result in nourishment to an infant.

As used herein the term "infant support frame axis" means a component attached to an infant device (such as an infant seat) which enables the device to pivot, rock, rotate or vibrate.

As used herein the term "control box" means a box-shaped or partially box-shaped structure which may contain or partially contain electrical components such as a sensor, microprocessor or power supply components.

DETAILED DESCRIPTION OF EMBODIMENTS OF THE INVENTION

For the purpose of promoting an understanding of the present invention, references are made in the text hereof to exemplary embodiments of an infant controlled apparatus, only some of which are depicted in the figures. It should nevertheless be understood that no limitations on the scope of the invention are thereby intended. One of ordinary skill in the art will readily appreciate that modifications such as those involving the number of components, positioning of the components relative to one another, materials from which the components are made, the size of the components, and the inclusion of additional elements do not depart from the spirit and scope of the present invention. Some of these possible modifications are mentioned in the following description. In addition, in the embodiments depicted herein, like reference numerals refer to identical structural elements in the various drawings. Therefore, specific details disclosed herein are not to be interpreted as limiting, but rather as a basis for the claims and as a representative basis for teaching one skilled in the art to employ the present invention in virtually any appropriately detailed system, structure, or manner.

Moreover, the term "substantially" or "approximately" as used herein may be applied to modify any quantitative representation that could permissibly vary without resulting in a change in the basic function to which it is related.

FIG. 1 shows a side view of one embodiment of infant controlled apparatus 100 in which infant seat 101, infant seat support frame axis 101', actuator 102, control box 103, sensor 104, microprocessor 105, tube-shaped conduit 106, and nipple 107 can all be viewed. In the embodiment shown, infant seat 101 is moved by actuator 102. In the depicted embodiment, actuator 102 is a linear actuator which causes infant seat 101 to rotate on infant support frame axis 101' so as to change the orientation of infant seat 101 so that the position of infant 108 is varied (e.g., to be more or less upright or more or less fully reclined).

In the embodiment shown, infant 108 sucks on nipple 107, which is connected to tube-shaped conduit 106, which in turn transmits changes in sucking parameters to sensor 104. In the embodiment shown, a change in air pressure in tube-shaped conduit 106, produced by sucking on nipple 107, is detected by sensor 104 and converted to a first electrical signal. The first electrical signal is transmitted to microprocessor 105, which then sends a second electrical signal to actuator 102. Actuator 102 controls the infant stimulation (e.g., movement such as re-positioning or rocking) of infant seat 101.

In other embodiments, sensor 104 may be placed elsewhere in infant controlled apparatus 100 and may measure other infant action such as verbalization or movement and may be placed in a component other than nipple 107. Additionally, infant controlled apparatus 101 may be a device other than an infant seat, such as a crib, stroller, stroller attachment, car seat, swing, bedding containing an electronic component (such as a mattress or blanket), a toy or any other type of device capable of being controlled by a signal produced by infant sucking parameters.

In the embodiment shown sensor 104 is a silicon pressure sensor PX138 series manufactured by Omega Engineering Inc. which uses machined silicon pressure sensors and provides a 1 to 6 Volt variable direct current output, although different makes and modes of sensors having varying direct current output may be used in alternative embodiments.

In the embodiment shown, actuator 102 is Electrac Q50 activator manufactured by Danaher Motion which is available for 12 or 24 Volt direct current output. It is rated for a maximum 120 pound load. In other embodiments, different models and makes of actuators operating with alternative power sources may be used.

In the embodiment shown, microprocessor 105 is an XLE Operator Control Station manufactured by Horner APG, LLC. In other embodiments, different models and makes of actuators operating with alternative power sources and capable of imparting movement to infant controlled apparatus 101 may be used.

Figure 2:
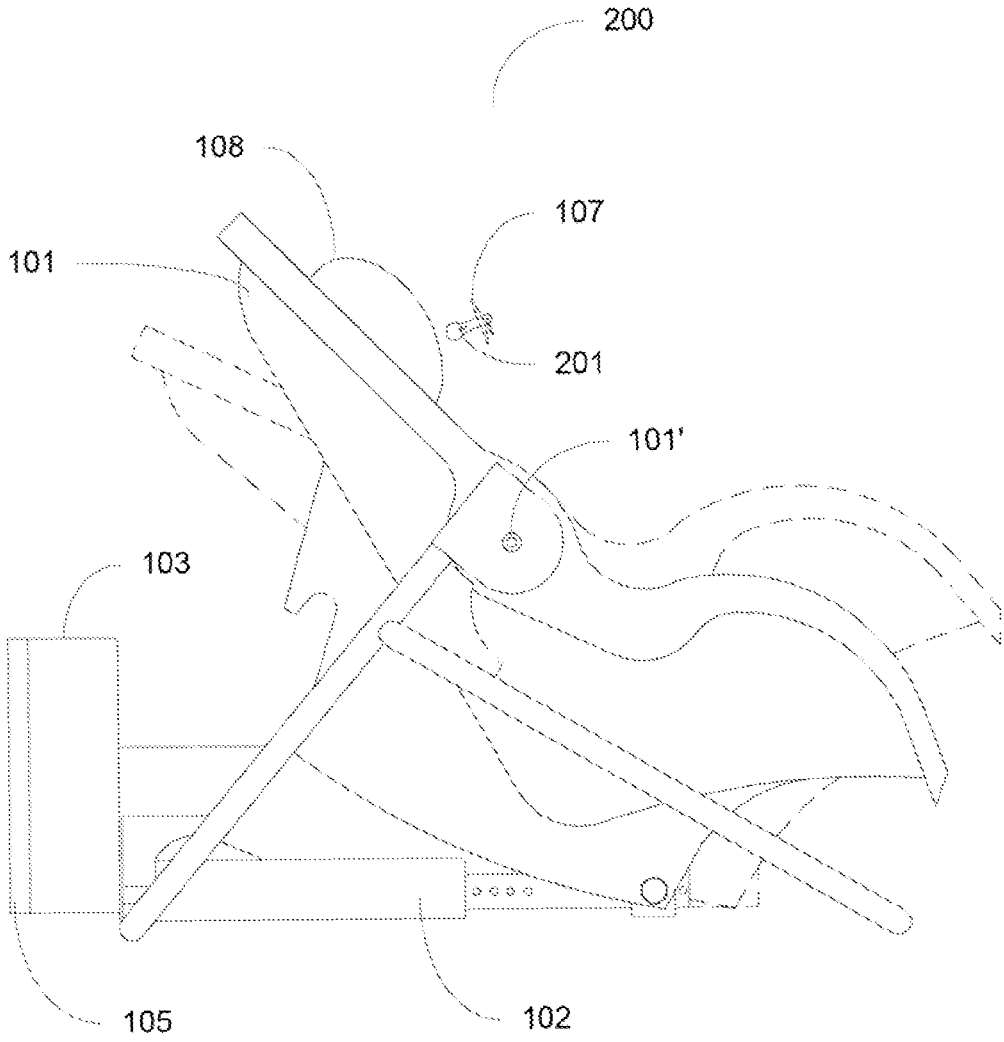
FIG. 2 is a side view of an alternate embodiment of the apparatus in which the nipple remotely controls the apparatus.

In other embodiments, infant controlled apparatus 100 may create an alternative infant stimulus, such as a visual stimulus, or a recorded sound (such as a verbal message). For example, visual stimuli may include figures on a mobile or other displays with lights, moving images or objects. Auditory stimuli may include a recording of a familiar speaking voice or sounds typical to animation FIG. 2 shows a side view of an alternate embodiment of infant controlled apparatus 200 in which infant seat 101, infant seat support frame axis 101', actuator 102, control box 103, sensor 201, microprocessor 105, nipple 107 containing an embedded sensor 201 for detecting changes in air pressure due to infant sucking parameters and capable of remotely sending a signal to microprocessor 105, and infant 108 can all be viewed. In the embodiment shown, as with the embodiment shown in FIG. 1, infant seat 101 is moved by actuator 102 and controlled by microprocessor 105. However, nipple 107, in which sensor 201 is embedded, is not physically connected to infant controlled apparatus.

In the embodiment shown in FIG. 2, actuator 102 is controlled by microprocessor 105, which receives an electrical signal remotely from nipple 107 containing embedded sensor 201.

While the infant controlled apparatus has been shown and described with respect to several embodiments in accordance with the present invention, it is to be understood that the same is not limited thereto, but is susceptible to numerous changes and modifications as known to a person skilled in the art, and it is intended that the present invention not be limited to the details shown and described herein, but rather cover all such changes and modifications obvious to one of ordinary skill in the art.

What is claimed is:

1. An infant actuated apparatus manipulated by an infant comprised of:

an infant support structure selected from a group consisting of an infant seat, a car seat, and a bassinette;

a sensor which detects at least one sucking parameter of an infant and creates a first electrical signal based on said at least one sucking parameter;

a microprocessor which receives and measures said first electrical signal based on at least one sucking parameter and creates a second electrical signal based on said first electrical signal to pivot said infant support structure; and an actuator which receives said second electrical signal and produces an infant stimulation output in response to said second electrical signal;

wherein said infant stimulation output is used by said infant to actuate said support structure pivoting on an axis so as to change the orientation of said infant support structure so that said infant is alternatively positioned in an upright position or a lying down position.

2. The apparatus of claim 1, wherein said sensor is attached to a nipple by a tube-shaped apparatus.

3. The apparatus of claim 1, wherein said sensor is embedded in a nipple which remotely sends said first electrical signal to said microprocessor.

4. The apparatus of claim 1, wherein said at least one sucking parameter is selected from a group consisting of an offset, an onset, a duration, an intensity, an interval between sucks, and combinations thereof.

5. The apparatus of claim 1, wherein said infant stimulation output is selected from a group consisting of a smooth motion movement, a bouncing movement, a rocking movement, a vibrating movement, a visual stimulation, a pre-recorded verbal audio stimulation, and combinations thereof.

6. An infant actuated apparatus to be manipulated by infant comprised of:

an infant support structure;

an infant support frame axis which enable said infant support structure to pivot an infant into a more or less upright position;

a sensor which detects at least one sucking parameter of an infant and creates a first electrical signal based on said at least one sucking parameter;

a microprocessor which receives and measures said first electrical signal based on at least one sucking parameter and creates a second electrical signal based on said first electrical signal; and an actuator which receives said second electrical signal and produces an infant stimulation output in response to said second electrical signal by pivoting said infant support structure between an upright position or a lying down position.

7. The apparatus of claim 6, wherein said apparatus is selected from a group consisting of an infant seat, a car seat, and a bassinette.

8. The apparatus of claim 6, wherein said sensor is attached to a nipple by a tube-shaped apparatus.

9. The apparatus of claim 6, wherein said sensor is embedded in a nipple which remotely sends said first electrical signal to said microprocessor.

10. The apparatus of claim 6, wherein said at least one sucking parameter is selected from a group consisting of an offset, an onset, a duration, an intensity, an interval between sucks, and combinations thereof.

11. The apparatus of claim 6, wherein said infant stimulation output is selected from a group consisting of a smooth motion movement, a bouncing movement, a rocking movement, a vibrating movement, a visual stimulation, a pre-recorded verbal audio stimulation, and combinations thereof.

12. An infant actuated apparatus to be manipulated by an infant comprised of:

an infant support structure;

an infant support frame axis which enables said infant support structure to pivot;

a nipple;

a sensor positioned within said nipple, said sensor is adapted to detect changes in pressure in said nipple in response to at least one sucking parameter of an infant and to create a first electrical signal based on said at least one sucking parameter;

a microprocessor which receives and measures said first electrical signal based on at least one sucking parameter and creates a second electrical signal based on said first electrical signal; and an actuator which receives said second electrical signal and produces movement of said infant support structure in response to said second electrical signal by pivoting said infant support structure between an upright position or a lying down position.

13. The apparatus of claim 12, wherein said infant support structure is selected from a group consisting of an infant seat, a car seat, a carrier, a swing, a stroller, a bassinette, and a harness.

14. The apparatus of claim 12, wherein said sensor is attached to said nipple by a tube-shaped apparatus.

15. The apparatus of claim 12, wherein said sensor is embedded in said nipple which remotely sends said first electrical signal to said microprocessor.

16. The apparatus of claim 12, wherein said at least one sucking parameter is selected from a group consisting of an offset, an onset, a duration, an intensity, an interval between sucks, and combinations thereof.

17. The apparatus of claim 12, wherein said infant stimulation output is selected from a group consisting of a smooth motion movement, a bouncing movement, a rocking movement, a vibrating movement, and combinations thereof.

* * * * *